United States Patent [19]

Evans, Jr. et al.

[11] Patent Number: 4,974,137

[45] Date of Patent: Nov. 27, 1990

[54] HIGH INTENSITY INDIRECT LIGHTING FIXTURE

[75] Inventors: Royal H. Evans, Jr.; Robert Rutledge, both of Wakefield, Mass.

[73] Assignee: Lam Lighting Systems, Wakefield, Mass.

[21] Appl. No.: 509,288

[22] Filed: Apr. 11, 1990

[51] Int. Cl.[5] ..... F21V 7/00; F21S 1/02

[52] U.S. Cl. ..... 362/300; 362/147; 362/301; 362/263; 362/348; 362/350

[58] Field of Search ..... 362/296, 297, 298, 299, 362/300, 301, 348, 350, 147, 263, 261

[56] References Cited

U.S. PATENT DOCUMENTS

| | | | |
|---|---|---|---|
| 1,612,856 | 1/1927 | Doane | 362/300 |
| 1,950,130 | 3/1934 | Barlow et al. | 362/300 |
| 2,294,007 | 8/1942 | Trautner | 362/299 |
| 3,389,246 | 6/1968 | Shemitz | 362/147 |
| 4,088,883 | 5/1978 | Dey | 362/263 |
| 4,186,433 | 1/1980 | Baldwin | 362/263 |
| 4,472,767 | 9/1984 | Wenman | 362/147 X |

*Primary Examiner*—Stephen F. Husar
*Assistant Examiner*—Peggy Neils
*Attorney, Agent, or Firm*—Charles E. Pfund

[57] ABSTRACT

A luminaire for high intensity indirect lighting providing a horizontally symmetrical light distribution with peak candle power at low angles is disclosed. The luminaire includes an inner light directing member nested in spaced relation within a generally dome-shaped outer translucent member. The inner light directing member includes means for directing the majority of light emitted by an axially located vertical light source out of the upwardly facing open end of the light directing member after no more than one reflection, and means for illuminating the outer translucent member to a substantially homogenious brightness level comparable to that of the surrounding ceiling.

13 Claims, 4 Drawing Sheets

HIGH INTENSITY INDIRECT LIGHTING FIXTURE

BACKGROUND

1. Field of Invention

The invention relates generally to indirect lighting fixtures. More particularly, the invention relates to high intensity indirect lighting fixtures which ar aesthetically pleasing in appearance and provide good low angle light distribution.

2. Summary of the Prior Art

Luminaires for indirect lighting rely upon the reflection of light from a source by specially shaped reflective means in a manner which directs the peak candlepower of reflected light at low angles so that its subsequent reflection by the ceiling illuminates the room effectively and efficiently. The use of this lifting technique in luminaires adapted for use in offices, large conference rooms, and other environments is well known. Beyond the functional characteristics of such luminaires, however, the consideration of their aesthetic appearance to, and their psychological impact upon, individuals also has been recognized to be important. In the latter regard, the shape of the fixture, the distance at which it is located from the ceiling, and its brightness relative to the illuminated ceiling are among the factors which influence the ultimate success or failure of a particular design in the marketplace.

In some situations, opaque fixtures have met with some success. These fixtures present fixed areas of darkness against the brightness of the surrounding ceiling which in some contexts do not detract from the appearance of the room, nor from the "usability" of the environment. In other situations, opaque fixtures visually tend to make the room appear smaller. This is particularly the case when the fixture is not located in a large room or in a room having a high ceiling. Therefore, they may adversely effect both the room's appearance and its "usability", especially by taller individuals. In the latter situation, it has been found that the illumination of the exterior surface of the luminaire visually tends to "lift" the luminaire, thereby alleviatinq the problem. This solution is optimized when the brightness of the exterior of the luminaire is substantially homogenious and equivalent to that of the surrounding ceiling.

Since relatively precise control of the reflection of light from the source is critical to the success of an indirect lighting fixture, it is customary to form thereflective elements from highly reflective specular metals. Cost and weight considerations usually dictate that these elements comprise formed thin sheets. Considerations of the effectiveness and efficiency of the light distribution dictate the specific contours given to the reflective surfaces. Accordingly, the exterior shape of the luminaire generally conforms to the contour of the inner reflective surfaces. Such exterior shapes are not necessarily aesthetically pleasing. This has not caused significant problems to luminaire designers, however, because the exterior shape of the luminaire need not effect the reflective interior contour of the reflective elements. It will be understood that either additional material may be added selectively to the exterior surface of the reflective elements, or an additional element, such as a dome, may surround the reflective elements to provide the desired aesthetically pleasing exterior shape.

The illumination of the exterior surface of the luminaire is not accomplished as easily. It, of course, is possible to provide separate lighting means between the exterior of the reflective elements and a outer translucent member to illuminate the exterior of the luminaire, but that alternative is cumbersome and costly. Designers in the art, therefore, have searched for ways to utilize some of the light from the source to provide the desired illumination of the exterior without significant adverse effect upon the indirect lighting characteristics of the device.

One alternative for achieving this goal is the provision of holes in the reflective member surrounding the light source. Extreme care must be taken in the placement of such holes because the indirect lighting capabilities of the device are easily compromised. Further, in this alternative bright spots or areas on the exterior surface of a translucent member surrounding the reflective member are to be expected. Such bright spots or areas detract from the overall appearance of the luminaire, and are to be avoided. In another alternative, the reflective elements may be made from materials which reflect some incident light, while allowing the remainder to diffuse therethough. These materials are generally deemed unsatisfactory for use in the formation of the reflective elements of an indirect lighting system because the amount of light reflected is not great enough for effective and efficient indirect lighting. In addition, since the concentrations of light rays impinging upon the reflective elements are not the same over the entire reflective surface, it can reasonably be expected that the exterior of a luminaire constructed of such alternative materials will display undesireable bright spots or areas. In yet another alternative, a small amount of the light leaving the open end of the reflective member adjacent its outer edge may be redirected into a gap between the reflective member and an outer translucent member. This alternative has the benefit that the indirect lighting characteristics of the device are not seriously compromised by the redirection of small quantities of light from the periphery of the light distribution directed at the ceiling. The symmetrical qeometry of the luminaire, however, is generally such that illumination of the central area of the outer translucent member by such reflected light will be prevented by the sides of the reflective member. Therefore, the central area will remain dark in comparison to the outer area. This dark area detracts from the appearance of the device just as bright spots or areas do, and should be avoided.

It further has been suggested that the alternative just described may be combined with the provision of an axial hole located in the bottom of the reflective member to allow illumination of the central area of the surrounding translucent member. In this suggestion, the outer translucent member comprises a pair of nested upwardly opening translucent domes surrounding the upwardly opening reflective member in an attempt to even out the exterior illumination. Also, a reflective element of the same dimensions as the hole is suspended between the hole and the horizontally located light source in an attempt to maintain the effectiveness of the indirect lighting capabilities of the device. The resulting illumination of the exterior of the outer dome is not homogeneous and does not match the brightness of the surrounding ceiling. Rather, the appearance is a comparatively brightly illuminated central area surrounded by a dimly illuminated outer area. This visual effect is an improvement over the opaque structures, but the visual "lift" it provides to the device is not totally satisfactory.

SUMMARY OF THE INVENTION

Accordingly it is the object of the present invention to provide an illuminaire having an effective and efficient indirect lighting capability and an aesthetically pleasing exterior shape, wherein the external surface is substantially homogeneously illuminated to a brightness level comparable to that of the surrounding ceiling.

This objective is accomplished in a preferred embodiment of the invention by providing a luminaire including an annular reflective plate, an inner upwardly opening light directing member and an outer upwardly opening, generally dome-shaped, translucent member. The annular plate has an outer diameter substantially the same as the diameter of the open end of the outer dome-shaped member, and an inner diameter substantially the same as the diameter of the open end of the light directing member. The outer lips of the walls of the light directing member and of the dome-shaped member are affixed respectively to the inner and outer edges of the annular plate such that the inner member is held in spaced, nested relation within the volume defined by the outer member. The luminaire is preferably suspended from a light socket in a manner which allows for the replacement of the light source without the use of tools. A vertical light source extends outwardly from the socket. This light source is located axially of, and substantially completely within, the inner light directing member. Preferably, the light source is a high intensity, metal halide lamp, however, incandescent and quartz light sources may also be utilized. The light socket is connected to a source of electrical energy through a stem. The stem also serves to space the luminaire from the ceiling, and may be of any desired length according to the height of the ceiling and the lighting characteristics desired to be achieved by the system.

The inner light directing member includes an upwardly opening reflective bowl including a flat, circular bottom portion defining an annular translucent window centered about the axis of the bowl substantially parallel to the annular plate. The side wall of the bowl curves upwardly and outwardly from the outer edge of the flat bottom portion, and defines a transparent cylindrical window adJacent the outer lip of the bowl. The inner reflective surfaces of the bowl are preferably made of processed specular aluminum to assure the accurate reflection of light rays impinging against them. The transparent window is a cylinder of transparent material affixed between the upper edge of the reflective portion of the wall of the bowl and its outer lip. In one embodiment of the invention suitable for low light source wattages (on the order of 250 watts), the annular translucent window may be formed by affixing a disc of translucent plastic to the inner side of the flat bottom of the reflective bowl in centered relation over an axial, circular aperture in the bottom of the bowl. An opaque metallic disc having a smaller diameter than the aperture is affixed to the inner surface of the translucent disc in centered relation to the aperture to complete the formation of the annular window.

In fixtures designed for higher wattage light sources (for example, 400 or 1000 watts), additional light filtration means covering the translucent window may be required to maintain the desired external illumination characteristics of the fixture. We have found that this may be effectively accomplished by the addition of an annular perforated metallic ring covering the inner surface of the translucent window. This ring may comprise either a perforated radial extension of the opaque disc or a separate perforated metallic disc covering the upper surface of the translucent disc prior to the attachment of the opaque disc thereto. Further, it has been found that as long as the point source of light equivalent to the light source is located on the bowl axis near the midpoint of the bowl heiqht, the outer geometrical configuration of the bowl need not be altered to accommodate light bulbs slightly longer than the height of the bowl. Instead, the central opaque disc may be replaced by an upwardly opening, shallow, generally bowl shaped housing extending through the central portion of the translucent disc/perforated disc combination, and adapted to accommodate the extra length of the light source. Accordingly, luminaire sizes may be maintained within aesthetically acceptable limits.

It has also been found that superior results are achieved when the opaque metallic disc and other metallic elements located inwardly from the edge of the aperture in the bottom of the reflective bowl are coated with high reflectance, low specularity white paint. This creates a wide distribution of the light reflected from those surfaces rather than a specifically directed reflections, and enhances the overall indirect lighting efficiency of the fixture.

A metallic trim ring may be affixed to the outer edge of the annular reflective ring to facilitate the attachment and removal of the outer dome-shaped member. The outer dome shaped portion generally is made of flexible, white opal acrylic, or equivalent material. Appropriate dust seals also may be provided to prevent insects, dirt, or other foreign matter from entering the space between the inner reflective bowl and the outer dome and adversely effecting the homogeneous illumination of the dome-shaped portion.

The reflective characteristics and optical shape of the light directing member are chosen such that the majority of the light emitted by the light source below the plane of the annular reflective plate leaves the luminaire through the open end of the light directing portion after only one reflection. In the preferred case, the side wall of the reflective bowl is vertically fluted to deflect reflected images away from the lamp. The outer dome shaped member is illuminated by light from the vertical side of the source passing through the cylindrical transparent window in the bowl wall and being reflected downwardly by the horizontal annular reflective plate. This reflected light illuminates approximately the outer two thirds of the surface of the dome shaped member. The inner third of the surface of the dome-shaped member is illuminated by light from the vertical side of the source diffusing through the translucent window in the bottom of the bowl. It will be understood, therefore, that substantially all of the illumination of the exterior surface of the outer dome-shaped member originates from the vertical side of the light source The concentrated light rays emitted by the tip of the source are reflected by the opaque disc (or bowl) to contribute to the indirect lighting distribution on the ceiling, and have little or no effect upon the illumination of the outer translucent member. By carefully correlating the width of the translucent window with the height of the transparent window, the brightness of the illumination of the outer two thirds and the inner third of the exterior surface of the outer dome-shaped member may be balanced at a level substantially the same as the brightness of the illumination of the ceiling. These dimensions will vary according to such factors as the size of the fixture, the intensity and shape of the light source, and the characteristics of the translucent materials chosen for the annular window and the dome-shaped member.

BRIEF DESCRIPTION OF THE DRAWINGS

These and other features and advantages of the invention will become apparent to those skilled in the art in view of the following detailed description of a preferred embodiment thereof with reference to the attached drawings in which.

DETAILED DESCRIPTION OF PREFERRED EMBODIMENT

Figure 1:
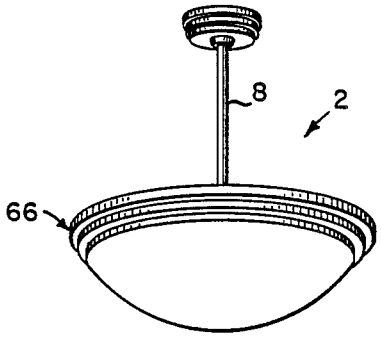
FIG. 1 is a side elevation of a high intensity indirect lighting fixture in accordance with the invention.

Referring now to the drawings, FIG. 1 shows a side elevation of a high intensity indirect lighting fixture in accordance with a preferred embodiment of the invention suitable for use with low wattage light sources (on the order of 250 watts). As will be seen in FIG. 2, the lighting fixture 2 is attached to a ceiling 4 at junction box 6 by stem 8. The stem may be of any desired length, as will be described below, and carries electrical power from the junction box 6 to the light socket 10. Light socket 10 is surrounded by a frustro conical housing member 12 attached to flange 14, which extends transversely from the end 16 of the stem 8, by screws 17. A light source 18 engages the socket 10 and extends downwardly therefrom. The light source 18 is preferably a high intensity, phosphor-coated, metal halide lamp of vertically elongated shape. The vertically elongated shape of light source 18 is important to the invention, but the specific type of lamp selected may vary. Thus, incandescent, quartz or other types of light sources may be utilized without departure from the present invention. A transparent cover 20 (usually glass) may be affixed to the housing 12 by thumb screws 22, if desired. Cover 20 surrounds and protects the light source 18.

The remainder of the fixture 2 includes an, annular, reflective plate 24, an outer dome-shaped member 26 and an inner light directing member 28. The outer dome-shaped member 26 is made of white opal acrylic, or similar translucent material, and includes an outwardly extending flange 30 located about its open end. The inner light directing member 28 is an upwardly opening reflective bowl. The bowl has a substantially flat bottom wall 34 defining a central aperture 36, and a side wall 38 which curves outwardly and upwardly from the bottom wall 34. Side wall 38 defines a generally cylindrical transparent window 40 (usually plastic) adjacent the open end of the bowl 32. Wall 38 also may be provided with vertical flutes 39 to deflect reflected images from the light source, if desired. In the drawing, window 40 is affixed to wall 38 by screws 42. It will be understood that this, and the other connections of elements of the invention referred to below, may be achieved with any convenient affixation means including, for example, rivets or adhesives, without departure from the present invention in its broadest aspects.

A disc of translucent material 44, aqain usually a plastic, is affixed to the inner side of the bottom wall 34 covering the aperture 36. We have found that the use of double sided adhesive tape works well for this purpose. Finally, a disc 46 of opaque reflective material (usually metal) is attached centrally to the upper side of the translucent disc 44 over the aperture 36. This attachment is shown as being accomplished by a pop rivet 48.

The inner light directing member 28 is suspended about the light source 18 so that the light source is axially located within the light directing member 28 between the aperture 36 and the plane of the horizontal reflector 24. We have found that the use of a three point suspension system for this purpose facilitates the replacement of the light source without the use of tools. This suspension system includes three suspension cables (or rods) 52 radiating in equally spaced relation from the open end of the light socket housing 12 to hooks 54 affixed to the inner side of the base of the wall 38. Specifically, cables (or rods) 52 are affixed to housing 12 by a pop rivets 56 at one of their ends, and have eyes 58 at their opposite ends. S-hooks 60 engage the eyes 58 and the hooks 54 to complete the suspension.

Figure 2:
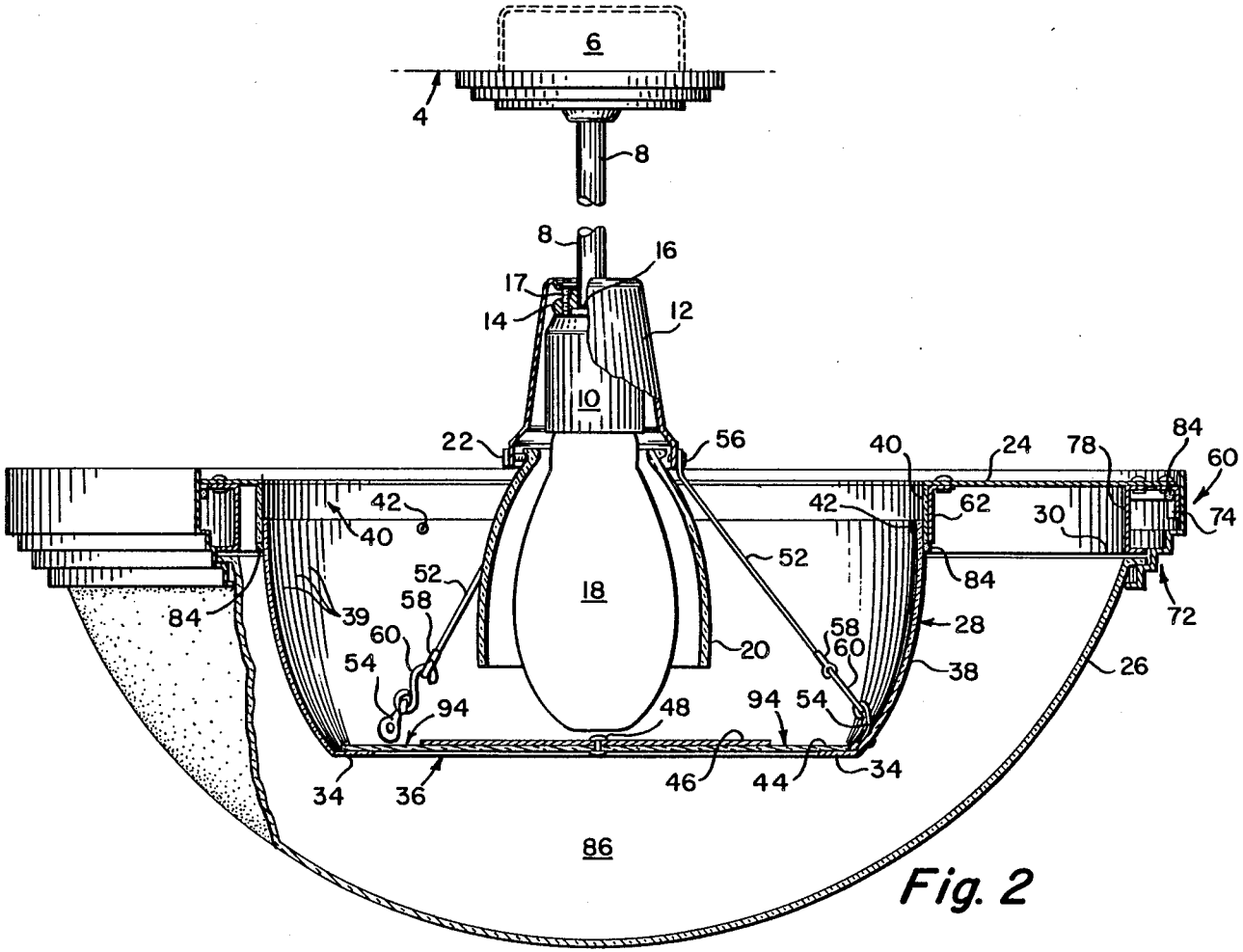
FIG. 2 is a cross-sectional side view of the high intensity indirect lighting fixture shown in FIG. 1.
Figure 2A:
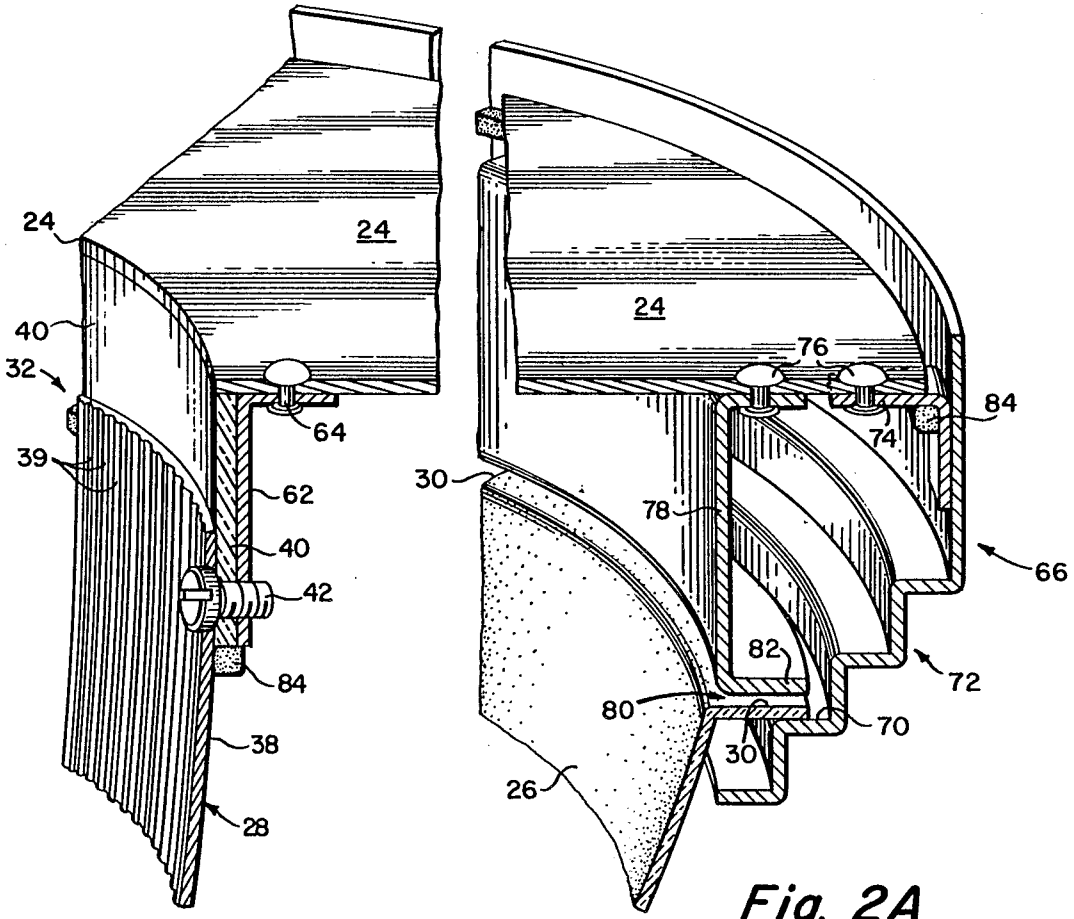
FIG. 2A is an enlarqed cross-sectional side view of the portions of FIG. 2 which show the attachment of the inner light directing member and the outer dome shaped member to the annular reflective member.

As best seen in FIG. 2A, brackets 62 spaced about the periphery of the open end of the light directing member 28 connect the upper end of the transparent window 40 to the lower side of the annular reflective plate 24 adjacent its inner edge. Pop rivets 64 and screws 42 affix the brackets 62 to the adjacent elements. A trim ring assembly, generally indicated at 66, is affixed to the lower side of the annular reflective plate 24 adjacent its outer edge. The trim ring assembly 66 has a generally right triangular shape with the base of the triangle located parallel to the lower surface of the annular reflective plate 24, and the hypotenuse extending inwardly and downwardly from the outer edge of the plate 24. The hypotenuse of this triangle may be curved or otherwise contoured in any desired aesthetically pleasing manner. The contoured outer portion 72 adjacent the apex of the triangle, however, must define a support ledge 70. As will be seen from the drawings, the trim ring assembly 66 specifically includes a contoured outer portion 72 having an inwardly extending brackets 74 adjacent its upper edge. Brackets 74 are affixed to the lower surface of the horizontal reflector 24 by pop rivets 76. The remainder of the triangular trim ring assembly is formed by a retainer clip 78 which is affixed to the lower surface of the plate 24 and defines a small gap 80 between its lower outwardly projectinq end 82 and the ledge 70. Retainer clip 78 may be manufactured either in the form of a ring, or as a series of separate clips disposed in spaced relation about the inner circumference of the trim ring. The outwardly extending flange 30 of the dome-shaped member 26 removeably engages the gap 80.

Figure 5:
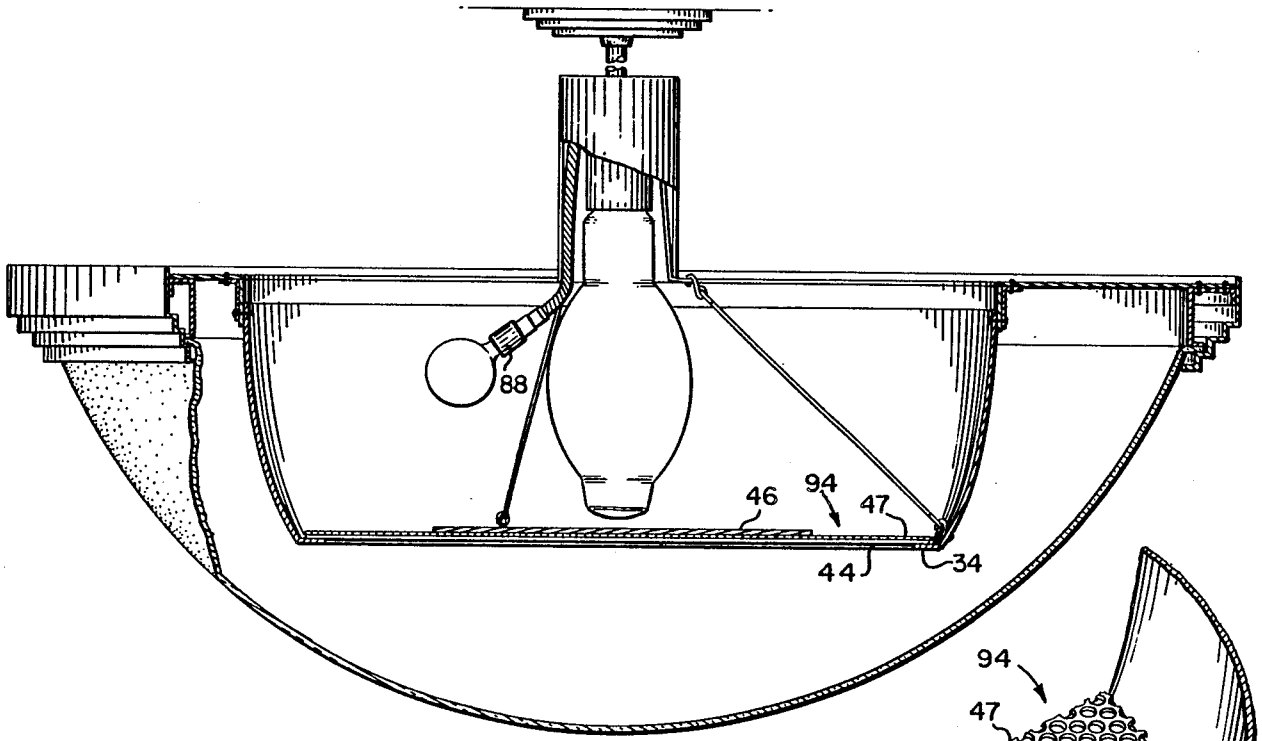
FIG. 5 is a cross sectional side view of a high intensity indirect lighting fixture in accord with the invention suitable for use with higher wattage light sources showing an auxilliary lamp associated therewith; and, FIG. 5A is a perspective cut away view of the annular translucent widow of the high intensity indirect lighting fixture shown in FIG. 5.

Permissibly, seals 84 of open cell foam, or some other appropriate material, are located adjacent the points of connection of the trim ring 66 to the annular reflective plate 24, and also adjacent the attachment of the reflecting bowl 28 to the transparent window 40. Seals 84 prevent insects, dirt, or other foreign matter from entering the space 86 between the inner light directing member and the outer dome shaped member. The presence of foreign matter within this area adversely effects the homogonious illumination of the dome shaped member by producing dark spots unattractive to individuals observing the device. Further, as best seen in FIG. 5, the luminaire may be provided with auxiliary lighting means, generally indicated at 88, for th provision of light during the start up phase of the high intensity lamp and/or as emergency lighting in the event of a power failure and/or component failure in the primary lighting circuit.

The basic geometrical relationship of the elements of the fixture of the invention will be apparent to those skilled in the art from FIG. 2. We have found that acceptable results are achieved with a device displaying the following dimensions when a low wattage lamp (on the order of 250 watts) having the basic shape depicted is utilized. Larqer lamps having wattages up to 1000 watts can be used in larqer versions of the device without departure from the invention in its broadest aspects as will be set forth below.

Figure 3:
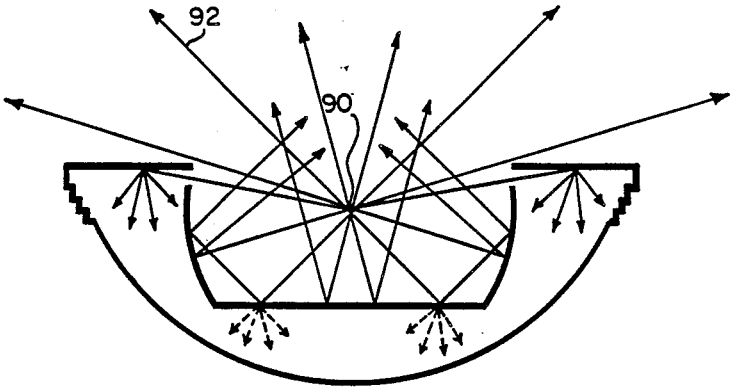
FIG. 3 is a diagramatical representation of the optics of the invention.
Figure 4:
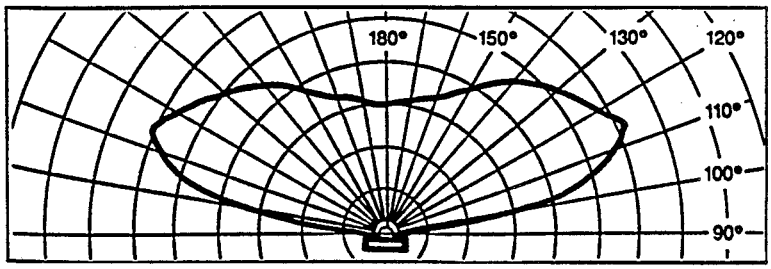
FIG. 4 is a graphical representation of the candle power distribution of the light directed at the surrounding ceiling from the invention.

Circumference of trim ring $=25\frac{3}{4}''$
Circumference of dome shaped member $=23''$
Heiqht of trim ring/dome assembly $=10''$
Heiqht of inner light directing means $=6''$
Circumference of bottom wall of light directing portion $=12''$
Circumference of open end of light directing means $=15''$
Circumference of aperture 36 $=10\frac{1}{4}''$
Circumference of metal disc 46 $=7\frac{7}{8}''$
Height of transparent window 40 $=\frac{3}{4}''$ The optical function of the device will also be apparent from FIG. 3. It will be recalled that the light source is located substantially axially within the cavity formed by the light directing member. For purposes of illustration, taking the light emitted from point 90 in all directions as indicative of the light emitted by the source 18, it will be seen that some of the light 92 leaves the luminaire directly through the open upper end of the light directing portion. The remainder of the emitted light is directed toward the walls of the light directing member. The majority of these light rays leave the luminaire through the upper open end of the light directing member after no more than one reflection. These rays, and those which left the luminaire directly after their emission by the light source, provide a light distribution above the open end of the light directing member which is horizontally symmetrical with peak candle power at low angles as indicated in FIG. 4. We have found that the following spacings of the annular reflective ring 12 from the ceiling result in the optimum light distributions for the luminaire described above.

| Ceiling Height | Distance of Luminaire from Ceiling |
|---|---|
| Up to 9'6" | $18\frac{1}{4}''$ |
| 9'6" to 10"6" | $21\frac{1}{4}''$ |
| Over 10'6" | $24\frac{1}{4}''$ plus 3" for each foot of added ceiling height |

The remaining rays pass either through the transparent window 40 or through the annular translucent window 94 located between the edge of aperture 36 and the outer edge of metal disc 46. The majority of the rays passing through the window 40 impinge upon the lower surface of the annular reflective plate 24. These rays are reflected downwardly against the inner surface of approximately the outer two thirds of the dome-shaped outer portion, thereby illuminating it. The rays passing through the translucent material of the disc 44 in the window 94 are diffused and impinge upon approximately the inner third of the dome-shaped outer portion to illuminate it. Since the light rays passing respectively through windows 40 and 94 originate at the side portions of the light source, their brightness and intensity are substantially the same. Therefore, it is possible by judiciously selecting the heiqht of the window 40 and the width and material of window 94 to equate the brightness of the illumination of the inner third of the outer dome-shaped member with the brightness of the outer two-thirds of the dome shaped member, and to equate those brightness levels to the brightness of the ceiling above the fixture.

Figure 5A:
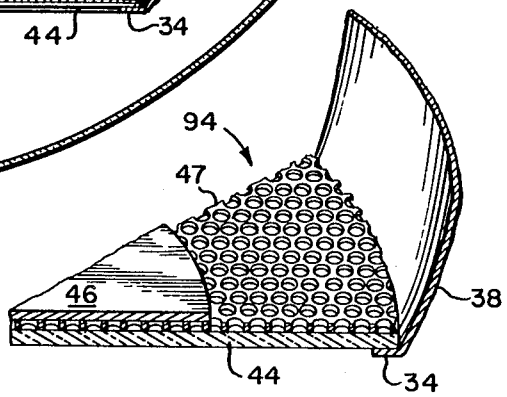

In higher wattage versions of the invention, it has been found that the use of readily available translucent materials, such as plastics, for the disc 44 allow too much light to illuminate the inner area of the outer translucent member. Accordingly, since the width of the annular window 94 cannot be altered significantly without detrimental effect upon the illumination of the outer member at the boundary between the central and outer portions of the exterior surface, means such as perforated metallic disc 47 (shown in FIG.5 and FIG. 5A) are utilized to filter the light passing through the window 94. Perforated metallic disc 47 is the same diameter as the translucent disc 44 and contains an array of small apertures filling at least the annular area adjacent its periphery having a width equivalent to the width of window 94. In assembling this modification of the invention, the perforated disc 47 is placed on top of the translucent disc 44. The opaque disc 46 then is attached centrally to the upper side of the perforated disc/translucent disc combination. A similar result may be obtained by radially expanding the diameter of the opaque disc 46 to equal that of the translucent disc 44 and providing an array of small apertures therethough in the added annular portion of the disc. Other light filtration methods also may be utilized without departure from the invention, however, the above described methods are preferred. This is because the areas between the apertures may be made reflective. Therefore, they contribute to the overall effectiveness and efficiency of the indirect lighting characteristics of the fixture. In the latter regward, we have found that coating the inner surfaces of the opaque disc and the perforated disc with high reflectance, low specularity white paint or the like enhances this result by reflecting light striking that surface into a broader area than a specular surface.

Having thus described a preferred embodiment of the present invention, those skilled in the art will realize that numerous modifications and alterations are possible without departure from the spirit and scope of the invention in its broader aspects. For example, the exterior surface of the inner light directing member and the lower surface of the annular ring may be coated with high reflectance, low specularity white paint to enhance the broad distribution of reflected light from those sur-faces. Further, an upwardly opening generally shallow bowl shaped member extending downwardly through the central portion of the translucent disc may be substituted for the opaque disc. This alternative allows the use of light sources having a vertical length slightly in excess of the heiqht of the reflective bowl without detriment to the optics of the luminaire. High wattage light sources therefore may be used without expanding the size of the luminaire beyond that which the aesthetics of the environment of intended use will tolerate. Such modifications and alterations are intended to be included within the scope of the invention, which is not to be limited by the above discussion of preferred embodiments thereof. The only limitations upon the scope of the invention are defined by the appended claims or their equivalents.

We therefore claim:

1. A high intensity indirect lighting fixture having an aesthetically pleasing illuminated shape comprising:

(a) an inner light directing member comprising an upwardly opening reflective bowl having a first substantially circular outer lip, and including a substantially circular bottom wall defining a centered, annular, translucent window, and a side wall curving upwardly and outwardly from the bottom wall defining a transparent, cylindrical window adjacent to the first outer lip, the optical shape of said reflective bowl being such that substantially all reflected light leaves its open end after no more than one reflection; and means for mounting a vertical source of high intensity light in spaced relation to said bottom and side walls substantially axially within said reflective bowl;

(b) an outer translucent member comprising an upwardly opening, substantially dome-shaped bowl having a second outer lip of a diameter greater than the diameter of said first outer (c) an annular reflective plate connecting said first and second outer lips;

The width of the annular window and the heiqht of the cylindrical window being selected such that the brightness of the illumination of approximately the central third of the outer member by light diffused through the annular translucent window is substantially equal to the brightness of the illumination of approximately the outer two-thirds of the outer member by light passing through said transparent cylindrical window and reflecting from said annular reflective plate.

2. The lighting fixture of claim 1 wherein said outer translucent member is white opal acrylic.

3. The lighting fixture of claim 1 wherein at least the side wall of the reflective bowl are processed specular aluminum.

4. The lighting fixture of claim 1 wherein the outer surfaces of the reflective portions of the light directing member are coated with low specularity white paint.

5. The lighting fixture of claim 1 wherein the light source mounting mean is attached to a stem for mounting to a ceiling.

6. The lighting fixture of claim 1 wherein said light directing member is attached to said light source mounting means by equally spaced connecting means running from said mounting means to the side wall of said light directing member adjacent the bottom wall thereof.

7. The lighting fixture of claim 1 wherein said outer translucent member is affixed to said annular reflective ring by a decorative metallic band.

8. The lighting fixture of claim 1 wherein the vertical light source is a high intensity, phosphor coated, metal halide lamp.

9. The lighting fixture of claim 1 wherein the side wall portion of the light directing means is vertically fluted such that reflected images are deflected away from the light source.

10. The lighting fixture of claim 1 wherein the brightness of the illumination of the outer translucent member is substantially equal to the brightness of the illumination of the ceiling above the fixture.

11. The lighting fixture of claim 1 wherein the portion of the bottom of the reflective bowl enclosed by the annular translucent window is coated with high reflectance, low specularity white paint.

12. The lighting fixture of claim 1 wherein the annular translucent window includes partially reflective light filtration means.

13. The lighting fixture of claim 12 wherein the partially reflective light filtration means comprises a second annular plate located on the inner surface of said annular translucent window, said second annular plate having a high reflectance, low specularity surface, the same diameter and width as said translucent window and an array of apertures therethough across its entire surface.

* * * * *